US005503586A

United States Patent [19]

Suto

[11] Patent Number: 5,503,586

[45] Date of Patent: Apr. 2, 1996

[54] STEERING APPARATUS

[75] Inventor: Shohei Suto, Tokyo, Japan

[73] Assignee: Taiyo Kogyo Co., Ltd., Tokyo, Japan

[21] Appl. No.: 371,106

[22] Filed: Jan. 11, 1995

[30] Foreign Application Priority Data

Apr. 12, 1994 [JP] Japan ..... 6-097011

[51] Int. Cl.[6] ..... A63H 29/24; A63H 17/36

[52] U.S. Cl. ..... 446/443; 446/460; 446/463; 74/810.1; 180/6.66

[58] Field of Search ..... 446/443, 460, 446/463, 456, 462; 180/6.66, 6.6, 6.2; 74/810.1; 192/93 A

[56] References Cited

U.S. PATENT DOCUMENTS

| | | | |
|---|---|---|---|
| 1,351,393 | 8/1920 | Marshall | 74/810.1 |
| 1,497,119 | 6/1924 | Reid et al. | 74/810.1 |
| 3,256,949 | 6/1966 | Petersen | 180/6.66 |
| 5,273,480 | 12/1993 | Suto | 446/456 |

FOREIGN PATENT DOCUMENTS

| | | | |
|---|---|---|---|
| 2239082 | 2/1975 | France | 446/443 |
| 2-94597 | 7/1990 | Japan . | |

*Primary Examiner*—Mickey Yu
*Attorney, Agent, or Firm*—Bartlett & Sherer

[57] ABSTRACT

An extremely simple gear system is disclosed whereby a pair of output gears may be controlled so as to rotate in the same or opposite directions. The gear system is particularly useful as the steering system for a toy vehicle in which a reversible motor drives a pair of steering gears in opposite directions on the same axis. A direction-control element is disposed on the same axis as that of the steering gears and is axially moved from first to second positions by cam mechanisms when the rotational direction of the motor is reversed. The direction-control element engages only one of the steering gears at a given time whereby a toy vehicle with the steering apparatus is controlled by changing the rotational direction of the motor such that the vehicle moves ahead or makes a turn.

20 Claims, 8 Drawing Sheets

STEERING APPARATUS

FIELD OF THE INVENTION

The present invention relates to a gear system in which a pair of output gears have their rotational directions changed when a drive motor changes its rotational direction, and more particularly, to a gear system which is particularly useful as a steering apparatus in a toy vehicle for controlling the vehicle's wheels so as to have the vehicle move ahead or turn on the spot.

BACKGROUND

Toy vehicles of conventional remote control types include vehicles in which the left and right-hand wheels are driven in the forward direction to move ahead and, wherein one of the wheels is used as a steering means when driven in reverse direction. That is, when a user wants to rotate the right-hand wheel in reverse direction, the left-hand wheel is rotated in forward direction. On the other hand, when the user wants to rotate the left-hand wheel in reverse direction, the right-hand wheel is rotated in forward direction so that the vehicle turns on the spot. In general, the above operations are realized by using a mechanism comprising clutches and planetary gears in which one of the wheels corresponds in rotational direction to the drive motor, and the other of the wheels always rotates in forward direction regardless of the rotational direction of the drive motor. For example, one such mechanism is disclosed in U.S. Pat. No. 5,273,480 assigned to the Assignee of the present invention. Such conventional steering apparatus using planetary gears and the like is complex in construction and requires a large number of components. Thus, the assembly is difficult and this increases its manufacturing cost.

SUMMARY OF THE INVENTION

It is an object of the present invention to provide a steering apparatus which is simple in construction and requires a minimum number of components whereby the apparatus may be assembled in an easy and rapid manner, manufactured at low cost, and which is reliable in operation.

According to a first aspect of the present invention, the above object of the present invention is accomplished by providing a steering apparatus comprising a motor controllable in rotational direction; a motor gear driven by the motor; first and a second steering gears which are meshed with the motor gear and are oppositely disposed from each other and rotated in opposite directions on the same axis; the first and the second steering gears being provided with ratchet and pawl means, such as cam and clutch means, in their surfaces facing each other such that each of the cam and clutch means transmit torque in only one direction; a cam shaft or direction-control element is disposed on the same axis between the first and the second steering gears, and is axially movable on the same axis between first and second positions so as to be engageable with each of the cam and clutch means on the first and second gears; the direction-control element being provided with first and second sets of cam and clutch surfaces on different, spaced-apart portions to engage with one of the cam and clutch means on the first and second gears when the direction-control element is in one position and disengage when it is in a second position; first and second intermediate gears are disposed on the same axis, the first intermediate gear preferably being integrally formed with the first steering gear while the second intermediate gear is preferably integrally formed with the direction-control element; and first and a second wheel-drive gears are driven by the first and the second intermediate gears, respectively.

According to a second aspect of the present invention, the motor is radio-controlled to change its rotational direction and is used to drive the right and left wheels of the toy vehicle.

According to a third aspect of the present invention, the motor gear comprises a reduction gear portion meshed with a pinion gear provided on an output shaft of the motor.

According to a fourth aspect of the present invention, the first and the second steering gears comprise first and second cylindrical crown gears having their toothed open-end portions oppositely disposed from each other.

According to a fifth aspect of the present invention, the cam and clutch means are disposed on the inner surfaces of the first and the second cylindrical crown gears; the inner surfaces being oppositely disposed from each other and perpendicular to the same axis.

According to a sixth aspect of the present invention, the direction-control element is provided with one set of cam and clutch surfaces on one of its ends, and is provided with a second set of cam and clutch surfaces on its mid-portion, with the opposite end of the direction-control element being formed into said second intermediate gear.

In summary, the first and the second steering gears mesh with the motor gear driven by the motor, and the steering gears are oppositely disposed from each other and driven in opposite directions. Disposed between these steering gears is the direction-control element which is provided with first and second cam and clutch surfaces and is axially moved so that: when the motor rotates in forward direction, the direction-control element engages with the clutch means on the first steering gear while the direction-control element disengages from the clutch means on the second steering gear. When the motor rotates in reverse direction, the first clutch means on the direction-control element disengages from the first steering gear's clutch means while the second clutch means on the direction-control element engage with the clutch means on the second gear. As a result, when the motor rotates in forward direction, both the first and the second intermediate gears rotate in the same direction, and mesh with the first and the second drive gears, respectively, so that both of the right-hand and left-hand wheels are driven in the forward direction. On the other hand, when the motor rotates in reverse direction, the first and the second intermediate gears are rotated in opposite directions while meshed with the first and the second drive gears, respectively, which causes the wheels to rotate in opposite directions through these intermediate gears. Consequently, it is possible for the gear system of the present invention to change the rotational directions of the pair of intermediate or output gears thereof by changing the rotational direction of the motor. This allows the drive gears, or other mechanisms, to be driven in opposite directions.

By radio-controlling the rotational direction of the motor mounted in a body of the toy vehicle, it is possible to move the vehicle ahead or turn the same in a very tight turn. By using the motor gear as a portion of the reduction gear system, it is possible to transmit a reduced speed to the first and the second steering gears. By using cylindrical crown gears as the first and the second steering gears, and by having the open-end toothed portions of the crown gears oppositely disposed from each other, it is possible to dispose the direction-control element between the open-end toothed portions of the crown gears. Also, by using crown gears for the steering gears, the first and second cam and clutch means for the first and second steering gears may be formed in the open-end inner surfaces of the first and second cylindrical crown gears, respectively. Further, the direction-control element may have a simple construction in which one of its ends is formed with a set of cam/clutch surfaces, while the central portion of the direction-control element may be formed with a second set of cam/clutch surfaces, and the opposite end of the direction-control element may be formed into the second intermediate gear.

DETAILED DESCRIPTION OF THE PREFERRED EMBODIMENTS

Figure 1:
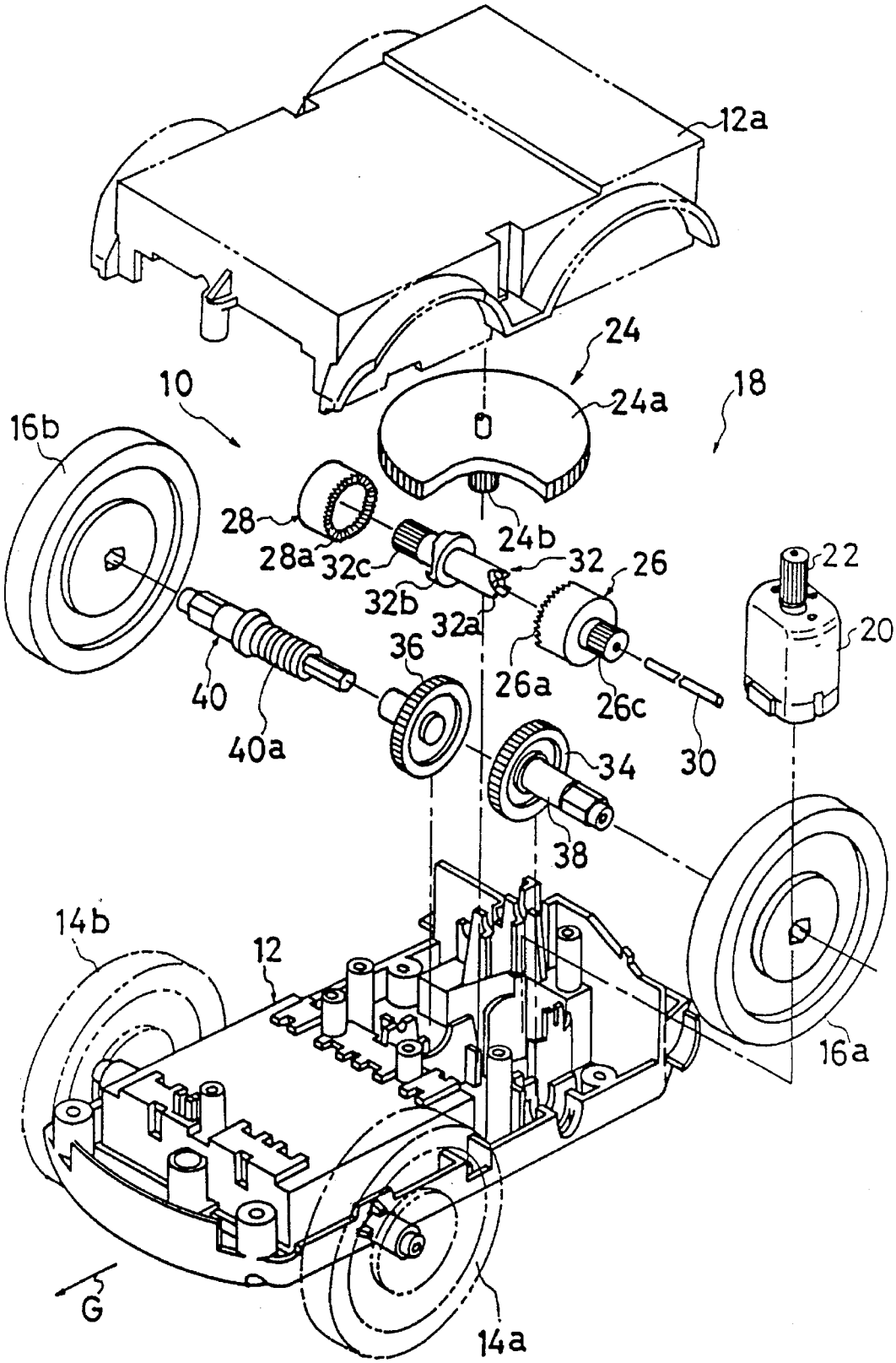
FIG. 1 is an exploded perspective view of the gear system comprising a steering apparatus of a toy vehicle illustrating one preferred embodiment of the present invention.

Referring first to FIG. 1, numeral 10 indicates a toy vehicle having a lower body portion 12 and an upper body portion 12*a* which body portions are mated and secured together when the toy vehicle is assembled. Lower body portion 12 is provided with a front left-hand wheel 14*a* and a front right-hand wheel 14*b* in its front portion, and a rear left-hand wheel 16*a* and a rear right-hand wheel 16*b* in its rear portion. The steering apparatus, generally designated by numeral 18, is also mounted in the rear portion of the vehicle, and through steering apparatus 18, rear wheels 16*a*, 16*b* are rotatably driven, and changed in their rotational directions, so as to change the moving direction of the toy vehicle 10 and cause it to turn on the spot.

Figure 2:
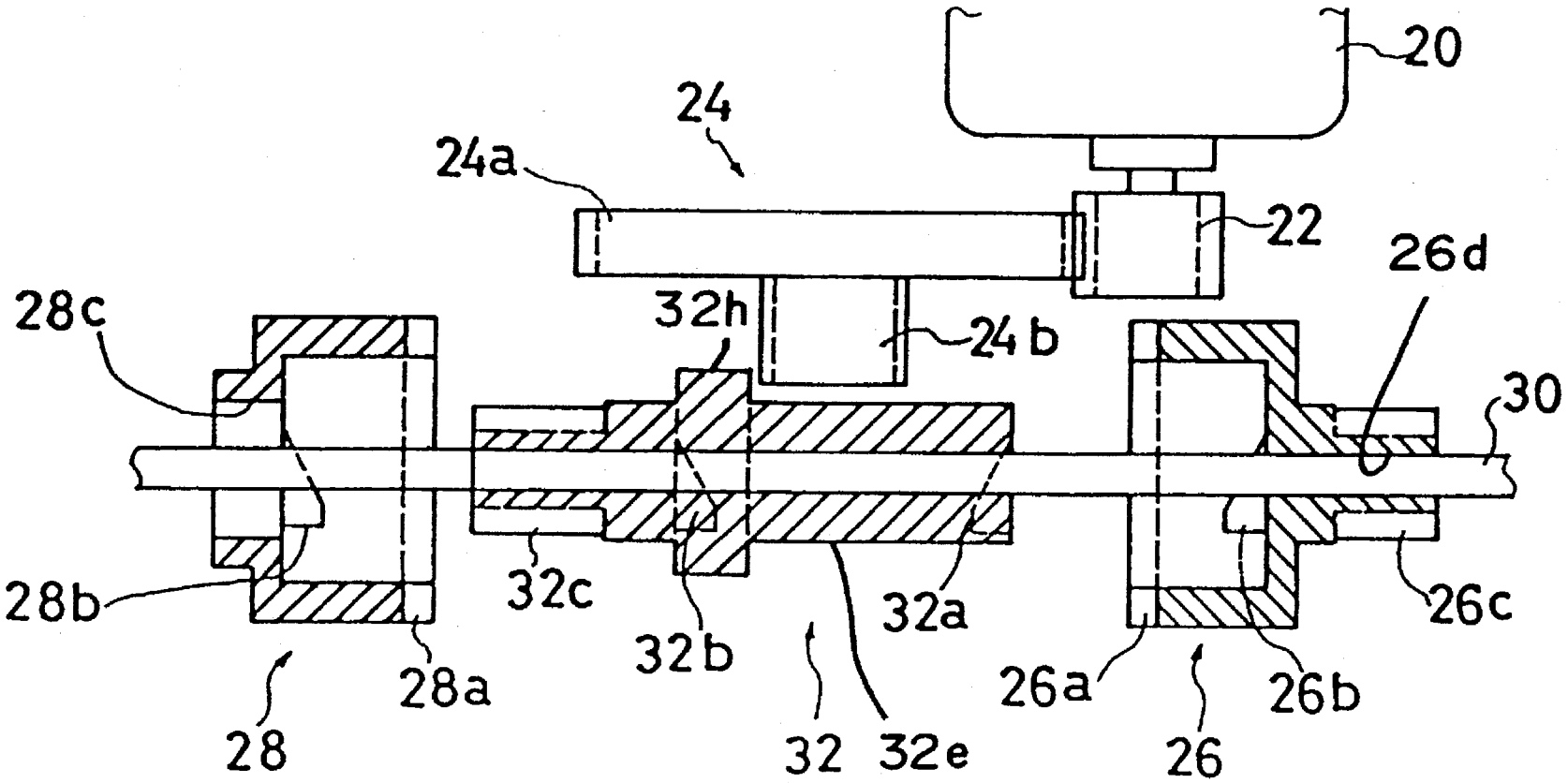
FIG. 2 is an enlarged, partially exploded view of the essential parts of the steering apparatus shown in cross-section.

As further shown in FIGS. 1 and 2, toy vehicle 10 includes a radio-controlled motor 20 for driving the vehicle's wheels. A pinion gear 22 is fixedly mounted on an output shaft of the motor 20, and preferably, a reduction gear 24 meshes with pinion gear 22. A first steering gear 26 and a second steering gear 28 mesh with a reduction gear portion 24*b*; steering gears 26, 28 being oppositely disposed from each other on the same axis and driven in opposite directions by reduction gear portion 24*b*. A spindle 30 rotatably supports the steering gears 26, 28 so as to rotate about the same horizontal axis. A generally cylindrical element 32, hereinafter referred to as a direction-control element, or simply a control element, is rotatably and axially slidably mounted on the spindle 30 so as to become engaged with one or other of the steering gears 26, 28 depending on the rotational direction of the motor 20 as will be further described hereinafter. A first intermediate gear 26*c* is integrally formed with first steering gear 26, and a second intermediate gear 32*c* is integrally formed on the left end of control element 32 as viewed in FIG. 2. As shown in FIG. 1, a first drive gear 34 and a second drive gear 36 mesh with the first intermediate gear 26*c* and the second intermediate gear 32*c*, respectively, for driving the rear left-hand wheel 16*a* and the rear right-hand wheel 16*b*, respectively.

As further shown in FIG. 1, motor 20 has its output shaft fixed to the pinion 22, and the output shaft extends vertically upwardly; the motor casing being fixed in a predetermined position of the body 12 of the toy vehicle 10. It will be understood that motor 20 is radio-controlled so as to be able to be started and stopped, and also to rotate in forward or in reverse directions, upon the command of the user. FIG. 1 illustrates motor 20 in one preferred embodiment as being mounted in a recess in lower body portion 12. However, it will be understood that motor 20 may be mounted in upper body portion 12*a* as shown schematically in FIGS. 2 and 10–13 and as will be more fully explained hereinafter.

Reduction gear 24, which has its rotational axis arranged vertically, reduces the rotational speed of pinion gear 22 and may be constructed of a large-diameter gear portion 24*a* which meshes with pinion gear 22, and a small-diameter gear portion 24*b* which may be integrally formed with the large-diameter gear 24*a* on the same axis. Reduction gear 24 preferably has its central axle mounted rotatably in upper body portion 12*a* such that, upon rotation of large gear portion 24*a* by pinion gear 22, a rotation of lesser RPM is transmitted to first and second steering gears 26, 28 by small gear portion 24*b*.

As most clearly shown in FIGS. 2–6, first steering gear 26 and second steering gear 28 preferably comprise a pair of cylindrical crown gears wherein each gear has a cylindrical portion and a vertical internal face portion. The ends of the cylindrical portions are formed with toothed portions 26*a* and 28*a* disposed oppositely from each other. The diameter, tooth shape and the number of teeth on the toothed portion 26*a* of the first steering gear 26 are the same as those on tooth portion 28*a* of the second steering gear 28. Also, it will be noted that the toothed portions 26*a*, 28*a* are preferably disposed facing opposite to each other on the same horizontal axis perpendicular to the forward moving direction of the body 12 so as to mesh with opposite sides of the small-diameter reduction gear 24*b*.

At this point it will be understood that, when the above-described components shown in the exploded view of FIG.

1 and the partially exploded view of FIG. 2 are in their assembled positions, these components of the steering system engage each other as shown in the operational schematics comprising FIGS. 10–13. However, before describing such schematics and the operation of the above-described components, it is necessary to more fully describe the structure and operation of control element 32, as well as the structure and operation of the cooperating cam and clutch surfaces on the control element and on the vertical faces of gears 26 and 28.

Figure 3:
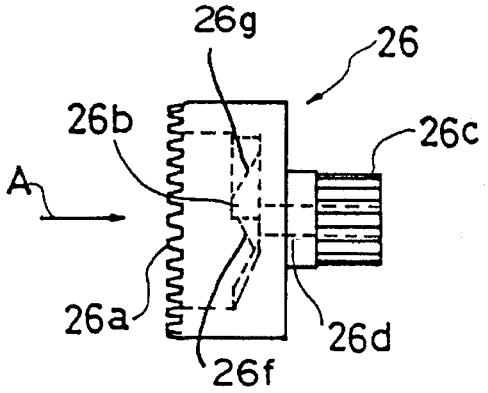
FIG. 3 is a side elevational view of the first steering gear of one preferred embodiment of the present invention.
Figure 4:
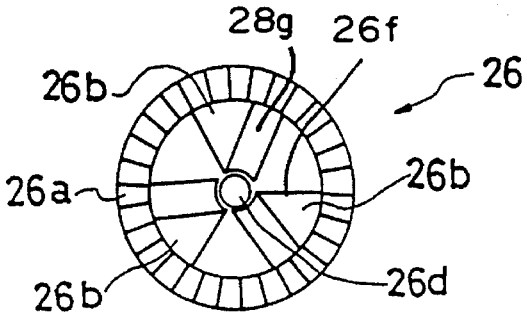
FIG. 4 is an elevational view of the first steering gear looking in the direction of arrow "A" of FIG. 3.
Figure 5:
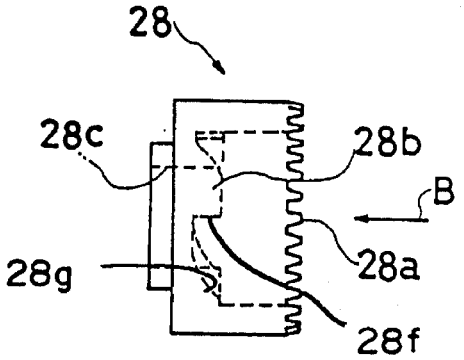
FIG. 5 is a side elevational view of the second steering gear of one preferred embodiment of the present invention.
Figure 6:
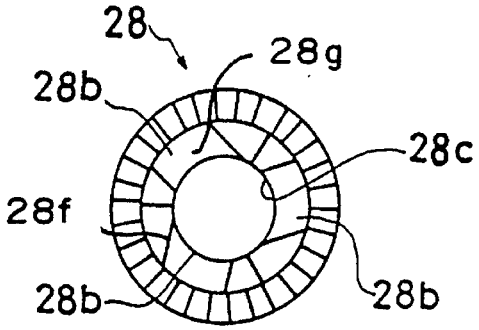
FIG. 6 is an elevational view of the second steering gear looking in the direction of arrow "B" of FIG. 5.

Referring to FIGS. 3 and 4, first steering gear 26 is provided with a plurality of cam and clutch elements 26*b* on its internal face. Each of these elements include a flat, horizontal surface 26*f* and an oblique surface 26*g* such that these surfaces act as a cam and one-way clutch when they are engaged by cooperating cam/clutch surfaces on the end of control element 32 as will be more fully described hereinafter. Similarly, as shown in FIGS. 5 and 6, second steering gear 28 has a plurality of elements 28*b* provided on its internal face. Each of elements 28*b* have flat, horizontal surfaces 28*f* and oblique surfaces 28*g* which also act as cam and one-way clutches when they are engaged by cooperating cam/clutch surfaces on the midportion of control element 32 as will be described more fully hereinafter.

As further shown in FIGS. 1, 2 and 7—9, control element 32 is disposed between first steering gear 26 and second steering gear 28 on the same rotational axis and, in the preferred embodiment, control element 32 comprises an elongated shaft-like element having a generally cylindrical shape. Control element 32 has the right end portion (as viewed in FIG. 7) formed into a relatively small-diameter shaft portion 32*e* and this shaft portion is sufficiently small in diameter so as to be capable of entering the open cylindrical portion of the first steering gear 26. A plurality of cam and clutch elements 32*a* are provided on the end surface of portion 32*e*. These include flat, horizontal clutch surfaces 32*f* and oblique cam surfaces 32*g* which are engagable with the previously described surfaces 26*f* and 26*g* of first steering gear 26. Control element 32 is further provided with a large-diameter flange portion 32*h* on its midportion. This flange portion has a diameter such as to loosely fit into the open cylindrical portion of second steering gear 28.

Figure 7:
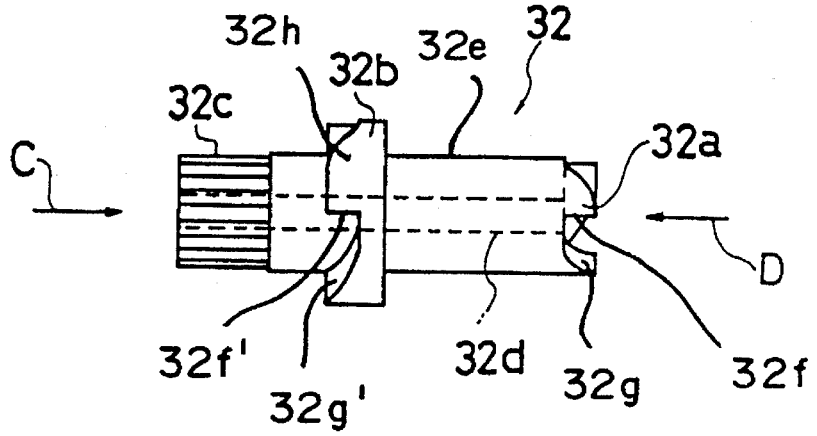
FIG. 7 is a side elevational view of the direction-control element of one preferred embodiment of the present invention.
Figure 8:
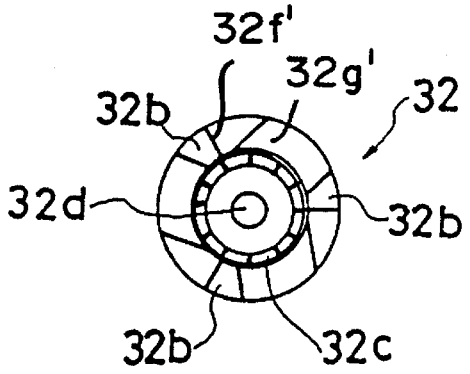
FIG. 8 is an elevational view of one end of the direction-control element looking in the direction of arrow "C" of FIG. 7.
Figure 9:
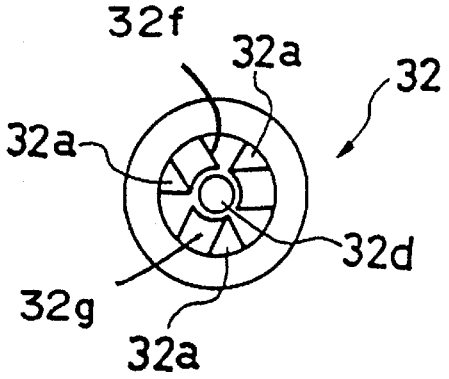
FIG. 9 is an elevational view of the other end of the direction-control element looking in the direction of arrow "D" of FIG. 7.
Figure 10:
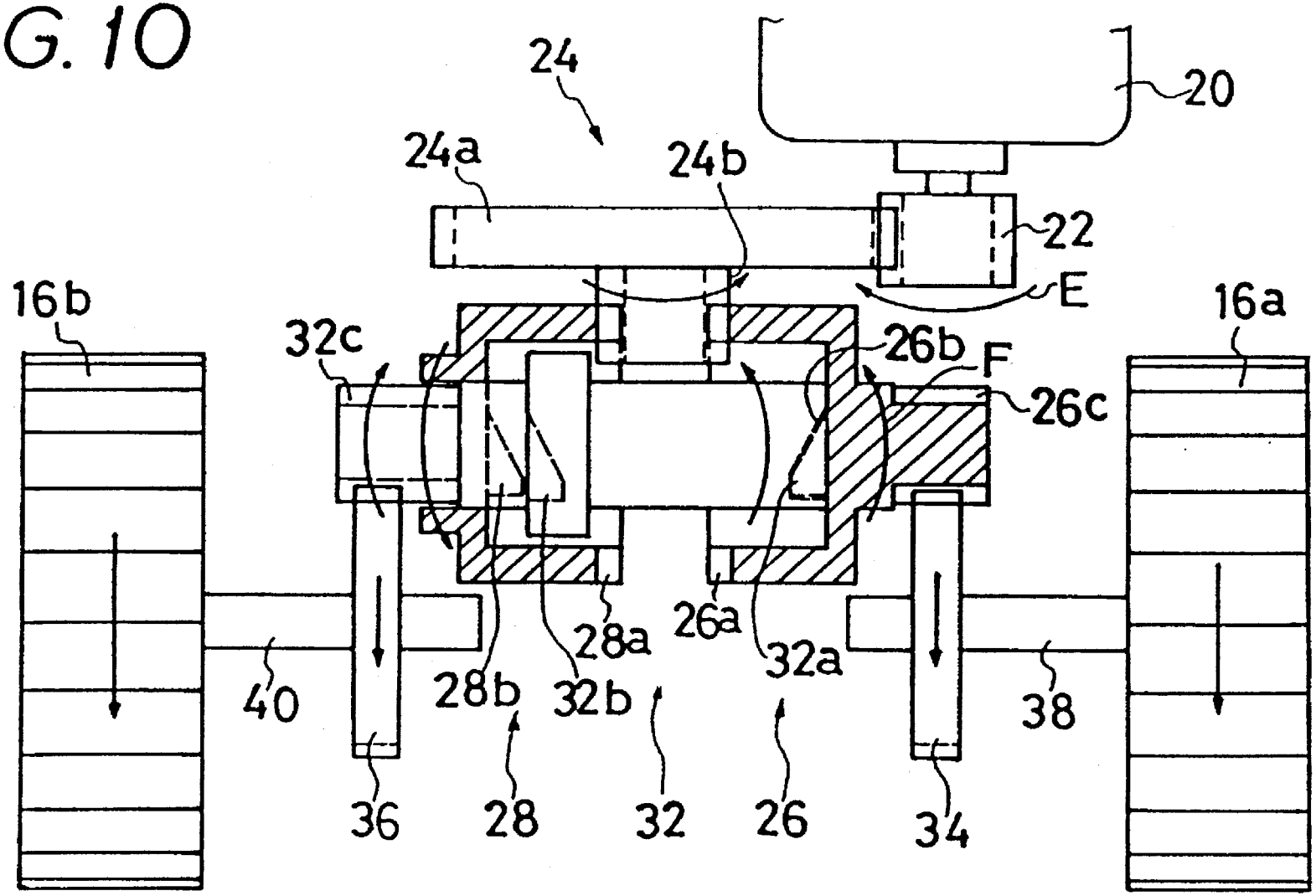
FIG. 10 is a schematic diagram of one preferred embodiment of the steering apparatus of the toy vehicle showing the positions and rotational directions of the parts when the vehicle moves in the forward direction.

As shown most clearly in FIGS. 7 and 8, flange portion 32*h* is provided on its vertical surface with a plurality of elements 32*b* which include flat, horizontal clutch surfaces 32*f* and oblique cam surfaces 32*g*' which are adapted to engage cam and clutch surfaces 28*f* and 28*g* of second steering gear 28 as previously described. Thus, as shown in FIG. 2, second intermediate gear 32*c*, which is formed on the left end of cam 32, may loosely fit through hole 28*c* in second gear 28 whereby cam and clutch surfaces 28*f* and 28*g* on gear 28 may engage cam and clutch surfaces 32*f* and 32*g* on flange 32*h* of control element 32, while gear 32*c* is exposed beyond the left side of gear 28 such as to be engagable with second drive gear 36 as shown in FIGS. 10–13. The axial distance between cam/clutch surfaces 32*a* and 32*b* is selected such as to permit one of these surfaces to be disengaged from the corresponding cam/clutch surfaces 26*b*, 28*b* on gears 26, 28 when the opposite cam/clutch surfaces are engaged with the associated cam/clutch surfaces on the other gear 26 or 28. That is, as shown in FIG. 10, control element 32 may shift into and out of engagement with surfaces 26*b* and 28*b* while both of steering gears 26, 28 remain meshed with gear portion 24*b* of reduction gear portion 24.

As shown in FIGS. 4, 6 and 8–9, each of the cam surfaces 26*b*, 28*b*, 32*a*, 32*b* may comprise, for example, three projecting sets of cam and clutch surfaces arranged circumferentially, and it will be apparent that the engagement of horizontal surfaces 26*f*, 32*f* and 28*f*, 32*f* comprise a one-way clutch which transmits torque in only one direction. In rotational movement in opposite directions, each of the oblique cam surfaces 26*g*, 28*g*, 32*g* and 32*g*' slide relative to the corresponding cam surface with which it is engaged so as to axially shift the position of control element 32. It will also be understood that each of cam and clutch elements 26*b*, 28*b*, 32*a* and 32*b* may be suitably designed as to the desired shape, and as to the desired angles of the oblique surfaces, depending upon the allowable amount of axial movement of the control element and the amount of sliding friction between the oblique surfaces. Further, it will be apparent that the number of the cams and clutch surfaces in each of the sets may be one, two, three or more as may be desired.

As shown in FIGS. 2 and 7, control element 32 includes a central bore 32*d* through which spindle 30 passes. That is, control element 32 is both rotatably and axially slidably mounted on spindle 30 by means of central bore 32*d*. On the other hand, the first steering gear 26 is rotatably, but not axially, movably mounted on the spindle 30 through its central bore 26*d*. The second steering gear 28 is rotatably mounted on the left shaft portion of control element 32 through its central hole 28*c*, which shaft portion is adjacent to the second intermediate gear 32*c* so that the second steering gear 28 permits control element 32 to be axially movable into and through its central hole 28*c*. It will also be understood that the spindle 30 has its opposite end portions supported by suitable bearing portions (not shown) which are formed in the rear portion of vehicle body 12.

As shown in FIG. 1, first drive gear 34 is fixedly mounted on one end portion of a first wheel axle 38. The rear left-hand wheel 16*a* is fixedly mounted on the other end portion of the first wheel axle 38 which has its intermediate portion rotatably mounted on a bearing portion of the lower vehicle body 12. On the other hand, the second drive gear 36 is fixedly mounted on one end portion of the second wheel axle 40. The rear right-hand wheel 16*b* is fixedly mounted on the other end portion of the second wheel axle 40 which has its intermediate portion rotatably mounted on a bearing portion of the lower vehicle body 12. A worm gear portion 40*a* is shown formed on a central portion of the second wheel axle 40; however, this gear relates to another drive system not relating to the present invention such that further description is not necessary.

Figure 11:
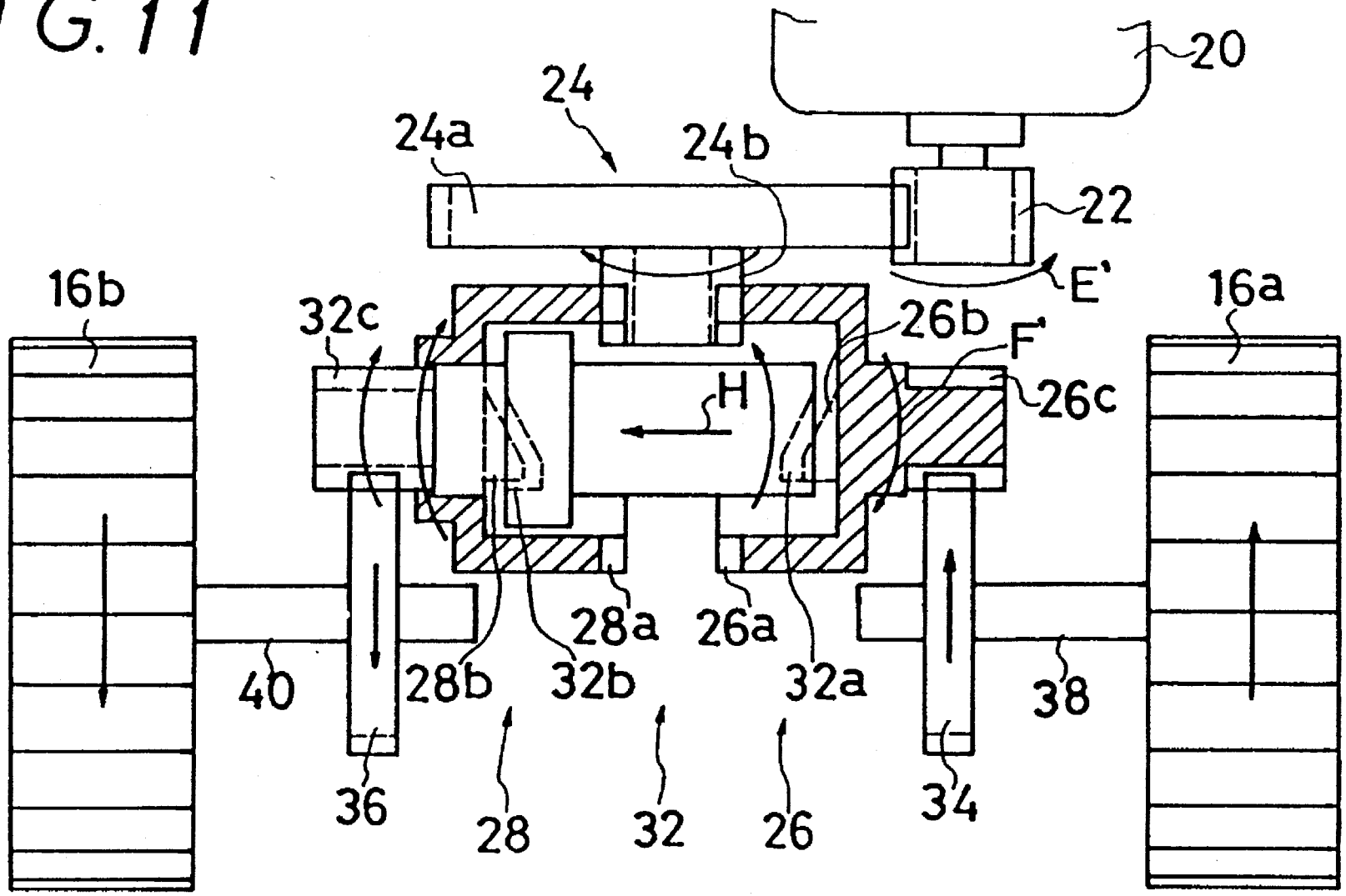
FIG. 11 is a schematic diagram of the same steering apparatus of the toy vehicle showing the positions and rotational directions of the parts in a transient condition when the vehicle moving forward begins to make a turn.
Figure 12:
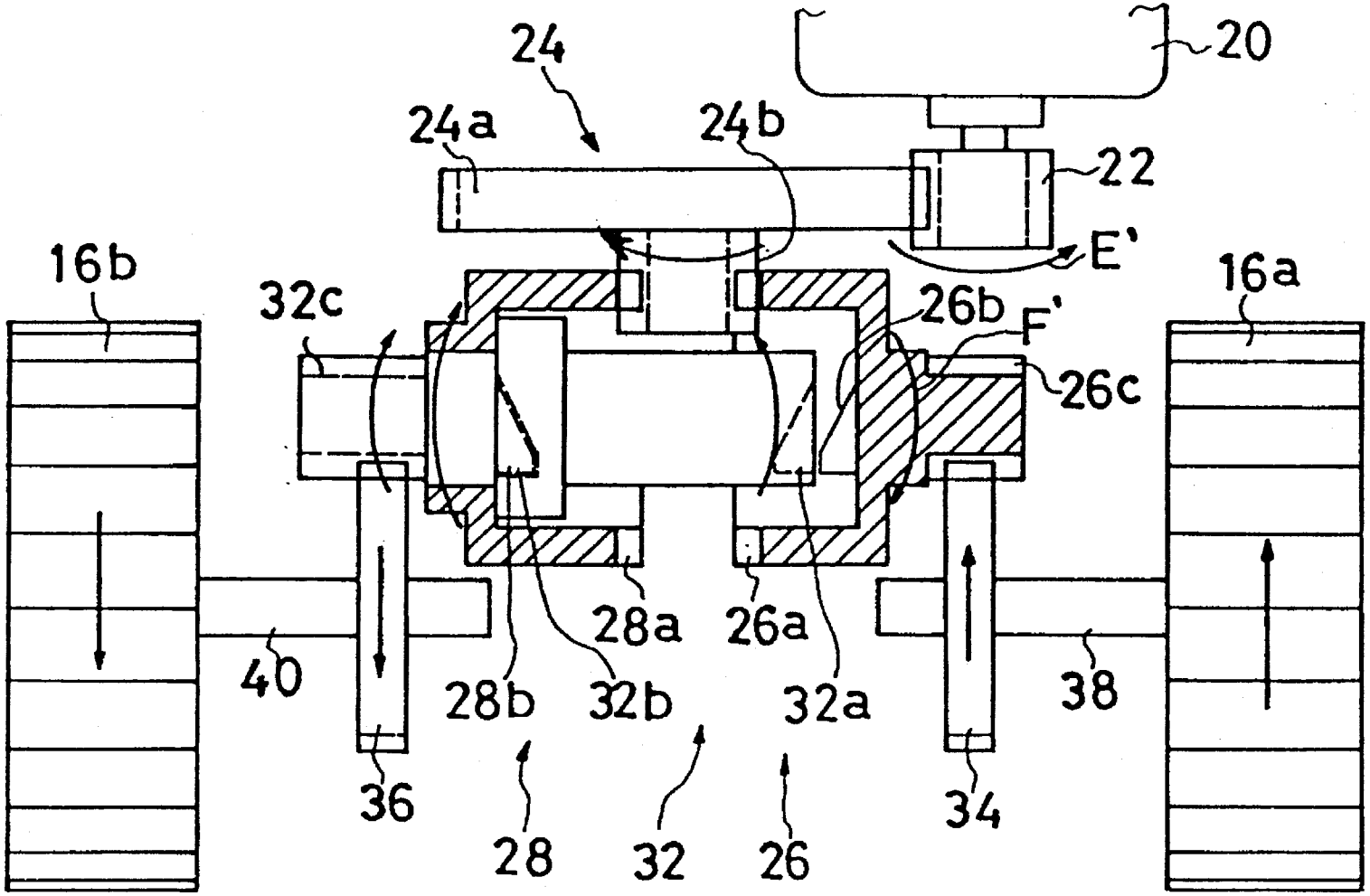
FIG. 12 is a schematic diagram of the same steering apparatus of the toy vehicle showing the positions and rotational directions of the parts in the condition in which the vehicle is making a turn.
Figure 13:
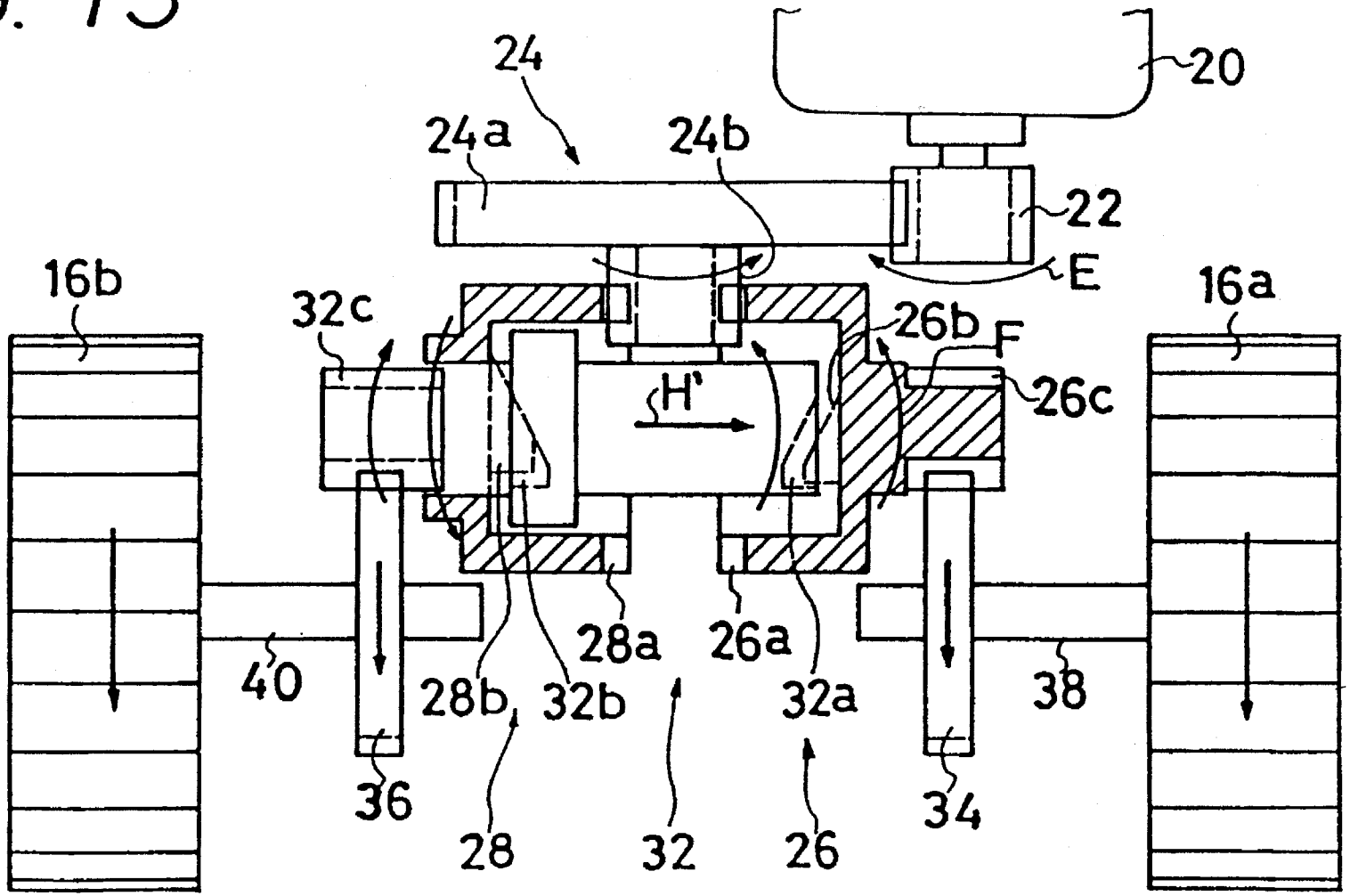
FIG. 13 is a schematic diagram of the same steering apparatus of the toy vehicle showing the position and rotational direction of the parts in a transient condition when the vehicle making a turn begins to resume forward movement.

The operation of the above-described steering apparatus will now be described with particular reference to FIGS. 10–13 wherein FIG. 10 shows the function of the parts when the vehicle is moving forward, and FIG. 11 shows the parts during a transient state of turning, and FIG. 12 shows the parts on completion of the turn, and FIG. 13 shows the parts during a transient state from the turning operation to the forward operation. It will be understood that FIGS. 10–13 are schematic and, for example, omit spindle 30 and the details of the individual sets of cam/clutch surfaces for the sake of clarity.

As shown in FIG. 10, in forward operation, control element 32 is in its right-most position whereby clutch elements 32*a* of the control element are meshed with clutch elements 26*b* of first steering gear 26, and in which position clutch elements 32*b* of the control element and 28*b* of the second steering gear 28 are disengaged. Under such circumstances, when pinion gear 22 rotates counterclockwise (as viewed from a position in front of the output shaft of the motor 20), reduction gear 24 is rotatably driven clockwise so that first steering gear 26 rotates clockwise (as viewed from the right-hand side of FIG. 10) in the direction of arrow F of FIG. 10, while second steering gear 28 rotates counterclockwise. In this condition, since control element 32 and first steering gear 26 are engaged as a one-way clutch, control element 32 also rotates clockwise. In other words, since both the first intermediate gear 26*c* of the first steering gear 26 and the second intermediate gear 32*c* of the control element 32 rotate in the same direction, both the rear left-hand wheel 16*a* and the rear right-hand wheel 16*b* are rotatably driven in the same direction through the first and second drive gears 34 and 36 which are meshed with the first and second intermediate gears 26*c* and 32*c*, respectively. As a result, the toy vehicle 10 moves ahead in the direction of arrow G of FIG. 1. At this time, although second steering gear 28 rotates counterclockwise as it is driven by reduction gear 24*b*, second gear 28 merely idles in turning around the shaft portion of control element 32 because cam/clutch elements 32*b* of the control element are disengaged from the cam/clutch elements 28*b* of gear 28.

Referring to FIG. 11, when it is desired to make a turn, the rotational direction of the motor 20 is reversed by radio-control of motor 20 so that pinion gear 22 is rotated clockwise; ie, in the direction of arrow E' of FIG. 11. As a result, first steering gear 26 is rotated counterclockwise in the direction of arrow F' while the second steering gear 28 is rotated clockwise. Under such circumstances, the oblique cam surfaces 26*g* of the first gear 26 slide on the corresponding oblique cam surfaces 32*g* of control element 32 so as to force the control element to move axially to the left as viewed in FIG. 11; ie, in the direction of arrow H of FIG. 11. For an instant, control element 32 remains under the resistance of left rear wheel 16*a* so that the control element moves axially to the left without rotating. When the control element moves to the left, clutch surfaces 32*b* of the control element engage with the clutch surfaces 28*b* of second steering gear 28. This causes control element 32 to also rotate clockwise since second steering gear 28 is rotating clockwise. In other words, as shown in FIG. 11, first intermediate gear 26*c* of first steering gear 26 and second intermediate gear 32*c* of control element 32 rotate in opposite directions, so that the rear left-hand wheel 16*a* and the rear right-hand wheel 16*b* also rotate in opposite directions through the first drive gear 34 and the second drive gear 36, respectively. As a result, the toy vehicle 10 makes a turn on the spot. At this time, although first steering gear 26 rotates counterclockwise, such rotation of the first steering gear does not interfere with the turning operation of the toy vehicle 10. That is, cam/clutch elements 26*b* of first gear 26 transmit torque only when first gear 26 rotates clockwise. When first gear 26 rotates counterclockwise, cam/clutch elements 26*b* merely push control element 32 to the left as is indicated by arrow H in FIG. 11. Consequently, when control element 32 and first steering gear 26 rotate in opposite directions, the oblique surfaces 32*g* of the control element are continuously pushed to the left to continuously move the control element to the left so that, as shown in FIG. 12, cam/clutch elements 26*b* and 32*a* become fully disengaged. In this condition, control element 32 and second steering gear 28 become clutched together so that rear wheel 16*b* continues to drive the toy vehicle 10 through its turning operation.

When the turning operation of the toy vehicle 10 is completed, motor 20 is stopped in operation by radio control. Thereafter, the motor is radio-controlled so as to rotate in forward direction. In this condition, as shown in FIG. 13, pinion gear 22 rotates counterclockwise (in the direction of arrow E of FIG. 13) so that the reduction gear portion 24 is rotated clockwise. This causes second steering gear 28 to rotate counterclockwise and first steering gear 26 to rotate clockwise. As a result, oblique cam surfaces 28*g* on second gear 28 slide on the corresponding oblique cam surfaces 32*g* on control element 32. This forces control element 32 to move axially to the right as shown by arrow H' in FIG. 13. At this time, since control element 32 is under the resistance of the rear right-hand wheel 16*b*, control element 32 moves to the right without rotating. When control element 32 moves to its right-hand position, cam/clutch surfaces 32*a* mesh with cam/clutch surfaces 26*b* on first gear 26 so that the operational condition shown in FIG. 10 is realized again and the toy vehicle moves forward. That is, since first steering gear 26 rotates clockwise, the control element also rotates clockwise since these are clutched together by clutch surfaces 26*f* and 32*f*. First intermediate gear 26*c* of first steering gear 26 and second intermediate gear 32*c* of control element 32 rotate in the same direction to drive rear left-hand wheel 16*a* and rear right-hand wheel 16*b* through first drive gear 34 and second drive gear 36, respectively, which makes toy vehicle 10 move ahead as previously described.

From the foregoing description of one preferred embodiment of the present invention it will be apparent that the steering apparatus enables the toy vehicle to move ahead or make a turn on the spot in a very simple manner by merely reversing the direction of the radio-controlled motor. In contrast with prior art apparatus, the steering apparatus of the present invention does not use any complex mechanism such as planetary gears and the like, and therefore, requires a minimum number of components. Consequently, the steering apparatus of the present invention is easy in assembly, low in manufacturing cost, and reliable in operation.

It will also be understood that, although both the first and second steering gears 26, 28 have been described as comprising crown gears, other shapes of gears such as bevel gears, spur gears and the like may be used. Also, although the steering gears 26, 28 have been described as being driven by the reduction gear portion 24 meshing with the pinion 22 which is driven by the motor 20, it is to be understood that steering gears 26, 28 may be directly driven by the pinion 22, or driven through a plurality of reduction gears, provided only that the steering gear 26, 28 are driven so as to rotate on the same axis in opposite directions. In addition, although the first and second drive gears 34, 36 have been illustrated as being driven directly by first and second intermediate gears 26*c* and 32*c*, it will be apparent that another reduction gear, or a speed-up gear, may be positioned between each of the intermediate and drive gears.

It is also to be understood that control element 32 may have other shapes and constructions, provided that this element is disposed on the common rotational axis of the first steering gear 26 and the second steering gear 28 so as to be axially movable therebetween. Also, it will be apparent that other forms of cam means and clutch means may be employed so long as such cam means disengage when the cam/clutch and the respective steering gear rotate in opposite directions, and engage each other when the cam/clutch and respective steering gear rotate in the same direction.

It will also be noted that, instead of driving the rear wheels, it is possible to drive the front wheels, or to drive all the wheels of the toy vehicle. Further, it is also possible to apply the present invention to a crawler-type toy vehicle in which a crawler or belt runs around each pair of the front and the rear wheels.

Further, in the above embodiment of the present invention, the single motor is radio-controlled so as to rotate in forward or in reverse direction, whereby the toy vehicle is moved ahead or makes a turn. Consequently, it is also possible to apply the present invention to the drive unit of any other toy so that the rotational direction of a pair of its output drives may be reversed by controlling the rotational direction of at least one drive motor thereof.

It will be understood that the foregoing description of one preferred embodiment of the present invention is intended to be illustrative of the principles of the invention, rather than limiting thereof, and that the legal scope of the invention is not to be limited other than as set forth in the following claims considered under the doctrine of equivalents.

I claim:

1. A steering apparatus for a toy comprising:

a reversible motor;

first and second steering gears, said first and second gears being spaced apart on the same axis of rotation and each being rotatable in forward and reverse directions;

first cam-clutch elements secured to said first steering gear and second cam-clutch elements secured to said second steering gear;

a direction-control element positioned on said axis of rotation of said steering gears and located between said first and second steering gears, said direction-control element being mounted for rotation on and axial movement along said axis between first and second positions;

first and second cam-clutch elements secured to first and second portions of said direction-control element and positioned such that said first cam-clutch elements on said direction-control element are engageable with said first cam-clutch elements secured to said first steering gear when said direction-control element is in said first axial position, and said second cam-clutch elements on said direction-control element are engageable with said second cam-clutch elements secured to said second steering gear when said direction-control element is in said second axial position;

first and second output gears, said first output gear being connected to rotate with said first steering gear and said second output gear being connected to rotate with said second steering gear; and at least one motor gear connected between said reversible motor and said steering gears for driving said steering gears in opposite directions whereby said output gears are driven in the same direction when said direction-control element is in said first axial position, and said output gears are driven in opposite directions relative to each other when said direction-control element is in said second axial position.

2. The steering apparatus of claim 1 wherein said toy is a vehicle, said toy vehicle having left and right wheels, and said output gears are connected to drive said wheels in the same direction when said direction-control element is in said first position so as to move said vehicle forwardly and to drive said wheels in opposite directions relative to each other when said direction-control element is in said second position so as to cause said vehicle to turn.

3. The steering apparatus of claim 2 wherein said motor gear includes a reduction gear of a size and configuration such as to drive said steering gears at a speed substantially less than the speed of said motor.

4. The steering apparatus of claim 2 wherein said reversible motor is a radio-controlled motor whereby reversing the direction of said motor reverses the direction of rotation of said steering gears such that said output gears rotate in directions opposite to each other whereby said toy vehicle turns.

5. The steering apparatus of claim 1 wherein said first cam/clutch elements secured to said first steering gear form a one way clutch with said first cam-clutch elements on said direction-control element when said first steering gear and said direction-control element rotate in the same direction.

6. The steering apparatus of claim 1 wherein said first cam-clutch elements secured to said first steering gear form a cam which pushes said direction-control element away from said first steering gear when said direction-control element and said first steering gear rotate in directions opposite to each other whereby said direction-control element is axially shifted into said second axial position.

7. The steering apparatus of claim 1 wherein said first and second steering gears are crown gears having a cylindrical portions and flat face portions, and wherein gear teeth are provided at the end of said cylindrical portions.

8. The steering apparatus of claim 7 wherein said first cam-clutch elements are secured to said flat face portion of said first steering gear.

9. The steering apparatus of claim 1 wherein said direction-control element comprises an elongated cylindrical element having first and second ends and a flange portion intermediate its first and second ends, and wherein said second cam-clutch elements are secured to said flange portion.

10. The steering apparatus of claim 1 wherein said first output gear is integral with said first steering gear and said second output gear is integral with said direction-control element.

11. The steering apparatus of claim 1 wherein said first and second output gears drive left-hand and right-hand wheels of a toy vehicle.

12. The steering apparatus of claim 11 wherein first and second drive gears are provided between said wheels and said first and second output gears.

13. A steering apparatus for a toy vehicle having left-hand and right-hand wheels comprising:

radio-controlled reversible motor means;

first and second steering gear means, said first and second steering gears means being spaced apart and mounted on the same axis to rotate in opposite directions;

reduction gear means connected between said motor and said steering gear means to rotate said steering gear means in directions opposite to each other at speeds less than that of said motor;

first cam/clutch means connected to rotate with said first steering gear means and second cam/clutch means connected to rotate with said second steering gear means;

direction-control means positioned between said first and second steering gear means, said direction-control means being movable into and out of engagement with said first and second cam/clutch means connected to said first and second steering gear means, respectively;

said direction-control means and said first and second cam/clutch means forming one-way clutches and disengaging cams depending upon the relative rotational directions of said steering gear means relative to said direction-control means;

first and second output gear means, said first output gear means being connected to rotate with said first steering gear means and said second output gear means being connected to rotate with said direction-control means; and first and second means connecting said first and second output gear means to rotate said left-hand and right-hand wheels of said toy vehicle whereby said vehicle is caused to turn by reversing the relative directions of said wheels upon reversing the direction of said motor by radio-control.

14. The steering apparatus of claim 13 wherein said reduction gear means comprises a first gear portion driven by said motor and a second gear portion of reduced diameter, said reduced diameter gear portion being positioned between and in engagement with each of said first and second steering gear means.

15. The steering apparatus of claim 14 wherein said first and second steering gear means comprise crown gears having toothed gear portions positioned on opposite sides of said reduced diameter gear portion and engaging said reduced diameter gear portion whereby rotation of said motor in a first direction causes said crown gears to rotate in first opposite directions and rotation of said motor gear in the reverse direction causes said crown gears to rotate in reversed opposite directions.

16. The steering apparatus of claim 13 wherein each of said first and second cam/clutch means comprise cam elements and clutch elements formed such that said clutch elements engage said direction-control means and form a one-way clutch when said direction-control element and one of said steering gear means rotate in the same direction, and whereby said cam elements cause said direction-control means to move away and disengage from one of said steering gear means when said direction-control means and steering gear means rotate in directions opposite to each other.

17. The steering apparatus of claim 16 wherein said cam elements comprise surfaces extending at an oblique angle to the axis of rotation of said steering gears.

18. The steering apparatus of claim 16 wherein said clutch elements comprise surfaces extending parallel to the axis of rotation of said steering gears.

19. A gear system for producing selectively controlled rotation of first and second output gears comprising:

a reversible motor;

first and second spaced-apart gears having toothed portions facing each other and said first and second spaced-apart gears being mounted for rotation on the same axis;

gear means driven by said reversible motor and driving said spaced-apart gears in opposite directions;

first and second sets of cam and clutch elements connected to said first and second spaced-apart gears, respectively;

a rotatable and axially moveable direction-control element having first and second positions, said direction-control element having first and second sets of cam and clutch elements, said first set being adapted to engage said cam and clutch elements connected to said first spaced-apart gear, and said second set being adapted to engage said cam and clutch elements connected to said second spaced-apart gear; each of said cam and clutch elements being shaped such as to form a one-way drive clutch when said direction-control element and the associated spaced-apart gear rotate in the same direction and being shaped such as to form a cam which shifts the position of said direction control element away from the associated spaced-apart gear when said direction-control element and the associated spaced-apart gear rotate in directions opposite to each other; and first and second output gears, said first output gear being rotated by said first spaced-apart gear and said second output gear being rotated by said direction-control element whereby rotation of said reversible motor in one direction causes both of said first and second output gears to rotate in the same direction and rotation of said reversible motor in the opposite direction causes said output gears to rotate in directions opposite to each other.

20. The gear system as claimed in claim 19 wherein said reversible motor is a radio-controlled motor and said first and second output gears drive left and right wheels of a toy vehicle so that the toy vehicle moves forward when said direction-control element is in its first position in clutching engagement with said first spaced-apart gear, and said toy vehicle turns when said direction-control element is in its second position in clutching engagement with said second spaced-apart gear.

* * * * *